US010845152B2

(12) United States Patent
Dextraze

(10) Patent No.: US 10,845,152 B2
(45) Date of Patent: Nov. 24, 2020

(54) INTERCHANGEABLE BARREL ASSEMBLY FOR A FIREARM AND METHOD OF CHANGING THE BARREL

(71) Applicant: CADEQUIP, INC., St-Jean-sur-Richelieu (CA)

(72) Inventor: Serge Dextraze, St-Jean-sur-Richlieu (CA)

(73) Assignee: CADEQUIP, INC., St-Jean-sur-Richelieu (CA)

( * ) Notice: Subject to any disclaimer, the term of this patent is extended or adjusted under 35 U.S.C. 154(b) by 0 days.

(21) Appl. No.: 16/349,319

(22) PCT Filed: Nov. 14, 2017

(86) PCT No.: PCT/IB2017/001515
§ 371 (c)(1),
(2) Date: May 13, 2019

(87) PCT Pub. No.: WO2018/087598
PCT Pub. Date: May 17, 2018

(65) Prior Publication Data

US 2020/0158460 A1 May 21, 2020

Related U.S. Application Data

(60) Provisional application No. 62/421,475, filed on Nov. 14, 2016.

(51) Int. Cl.
*F41A 35/00* (2006.01)
*F41A 21/48* (2006.01)
*F41A 11/02* (2006.01)

(52) U.S. Cl.
CPC ..... *F41A 35/00* (2013.01); *F41A 21/481* (2013.01); *F41A 21/482* (2013.01); *F41A 11/02* (2013.01)

(58) Field of Classification Search
CPC ..... F41A 35/00; F41A 21/481; F41A 21/482; F41A 11/02

(Continued)

(56) References Cited

U.S. PATENT DOCUMENTS 3,708,841 A 1/1973 Quinney
3,842,527 A * 10/1974 Low ..... F41A 21/482 42/75.02

(Continued)

FOREIGN PATENT DOCUMENTS

WO WO2014/066759 A1 5/2014

OTHER PUBLICATIONS

European Search report issued in EP counterpart application No. 17869374.3 dated Jul. 9, 2020.

*Primary Examiner* — Samir Abdosh
(74) *Attorney, Agent, or Firm* — Norton Rose Fulbright Canada LLP

(57) ABSTRACT

An interchangeable barrel assembly for a firearm including a novel barrel and tool assembly which are used with a receiver having an open aft end. The tool assembly is configured to be inserted into the receiver open aft end so as to engage the aft end of the barrel. Torque applied to the tool assembly thereby transfers torque to the barrel without transferring forces to the action. This enables the same action to be used with different barrels and the barrel may be removed without removing the receiver or other components of the modular chassis or accessories mounted thereon. Additionally, standard torque may be applied to the barrel for connection to the receiver and firearm precision is maintained.

16 Claims, 14 Drawing Sheets

(58) Field of Classification Search
USPC ..... 42/75.01, 75.02
See application file for complete search history.

(56) References Cited

U.S. PATENT DOCUMENTS

| | | | | | |
|---|---|---|---|---|---|
| 4,109,403 | A * | 8/1978 | Badali | F41A 21/484 | 42/75.02 |
| 4,288,938 | A * | 9/1981 | Kahn | F41A 21/488 | 42/59 |
| 5,592,770 | A | 1/1997 | Gudgel | | |
| 5,987,797 | A * | 11/1999 | Dustin | F41A 21/482 | 42/75.02 |
| 6,032,398 | A * | 3/2000 | Carpenteri | F41A 35/00 | 42/79 |
| 6,209,250 | B1 | 4/2001 | Mills | | |
| 6,266,908 | B1 | 7/2001 | Spencer et al. | | |
| 8,397,416 | B2 * | 3/2013 | Laney | F41C 23/16 | 42/75.02 |
| 8,429,844 | B2 * | 4/2013 | Dextraze | F41A 3/18 | 42/73 |
| 8,782,943 | B2 * | 7/2014 | Jarboe | F41A 21/485 | 42/75.02 |
| 9,372,041 | B1 | 6/2016 | Geissele | | |
| 9,631,889 | B2 * | 4/2017 | Geissele | B25B 13/48 | |
| 9,702,652 | B1 * | 7/2017 | Jackson | F41A 21/482 | |
| 2001/0042333 | A1 * | 11/2001 | Spencer | F41A 21/485 | 42/75.02 |
| 2012/0073177 | A1 * | 3/2012 | Laney | F41C 23/16 | 42/16 |
| 2014/0115938 | A1 * | 5/2014 | Jarboe | F41A 21/485 | 42/71.01 |
| 2015/0247695 | A1 * | 9/2015 | Jarboe | F41A 21/485 | 42/71.01 |
| 2016/0010938 | A1 * | 1/2016 | Merkley | F41A 21/482 | 42/75.02 |
| 2016/0202008 | A1 * | 7/2016 | Geissele | F41A 11/00 | 42/108 |

* cited by examiner

INTERCHANGEABLE BARREL ASSEMBLY FOR A FIREARM AND METHOD OF CHANGING THE BARREL

FIELD OF THE INVENTION

The present invention is directed to an interchangeable barrel assembly for a firearm including an interchangeable barrel and a tool assembly wherein the barrel of the firearm may be readily removed from and applied to the firearm receiver without removing the action from the firearm chassis and, therefore, without removing accessories mounted to the action and maintaining firearm precision.

BACKGROUND OF THE INVENTION

Firearms having the ability to provide multiple caliber systems are desirable to hunters, sportsmen, and perhaps, particularly, in military applications. In military applications, modular firearm systems, such as the modular stock system of U.S. Pat. No. 8,429,844, are easily reconfigurable for varying operational needs. Moreover, such systems provide compact systems for changing environments and operational needs. Important to modular stock systems is the ability to change the caliber of the firearm, which may require changing the barrel whether due to different operational requirements, damage or wear.

Heretofore, firearms with interchangeable barrels have required special tools and procedures. Conventional firearms include a barrel having a threaded aft end which mates with a threaded fore end of the receiver housing the action. The receiver must be removed from the stock and all accessories, such as a Picatinny rail, scope, night vision, etc., must also be removed. Cumbersome tools are required to secure the receiver in place while the barrel is removed by another tool so as to overcome the secure connection between the receiver and the barrel required for the firearm. This is accomplished, typically, with a specialized jaw to hold the receiver and a specialized wrench to prevent damage to the various parts of the assembly. According to these prior art systems, the stock assembly must be wholly disassembled and the action must be reinstated to its prior configuration and all accessories re-zeroed and/or reset when it is desirous to change the barrel of the firearm. Therefore, these systems do not permit multiple barrels utilizing the same action.

Other prior art systems provide a threaded sleeve or lug which serve as in interface between the receiver and the barrel to permit interchangeable barrels. An exemplary prior art lug is a pinch lug of U.S. Pat. No. 7,451,564 B2. The lugs or sleeves are generally positioned around the aft end of the barrel, thereby requiring additional longitudinal space along the length the action and the barrel and the stock chassis must accommodate this space. Moreover, such sleeves or lugs may interfere with use of accessories on the stock chassis. For example, if a scope were installed on the stock chassis, it would have to be removed to access the sleeve or lug so as to remove the barrel.

Firearm components understandably require manufacturing and assembly precision for accurate and consistent performance. When changing components of a firearm system, maintaining precision is a necessary consideration. Of particular importance when changing a barrel of a firearm is to maintain the headspace, which is the distance between the face of the bolt and the rear of the bullet cartridge within the action. Maintaining a predetermined headspace ensures precision and repeatability of the firearm. Barrels are threaded into the action and, depending upon the pitch of the thread, the engagement of the barrel to the receiver effects headspace. Therefore, a precise torque is required when engaging the barrel to the receiver to maintain precise and consistent headspace. This is a particular consideration with multi-component systems such as with stock systems with interchangeable barrels. These and other shortcomings of the prior art are met by the present invention.

SUMMARY OF THE INVENTION

In accordance with preferred embodiments of the present invention, the present invention obviates shortcomings of the prior art by providing a barrel assembly which may be readily removed without removing the action from the chassis permitting variable barrels to be used with a single action. Moreover, the barrel assembly of the present invention obviates the need to remove accessories mounted on the stock chassis such as a telescope, top rail (Picatinny), fore-end tube, etc. This is accomplished by providing a novel tool assembly which may be inserted co-axially into the receiver of the action without substantially interfering with any accessories mounted thereon. This is also accomplished without having to remove the action from the chassis. The present invention further provides a novel barrel assembly which engages the receiver so as not to negatively impact the headspace. The method of changing the barrel for a single action is readily accomplished without the use of cumbersome apparatuses or tools, rendering a modular stock system more versatile.

These and other objectives are met by the present invention which provides an interchangeable barrel assembly for a firearm, such as a bolt action sniper rifle having a modular chassis, including a novel barrel and tool assembly which are used with a receiver having an open aft end. The tool assembly is configured to be inserted into the receiver open aft end so as to engage the aft end of the barrel. Torque applied to the tool assembly thereby transfers torque to the barrel without transferring forces to the action. This enables the same action to be used with different barrels and the barrel may be removed and/or applied without removing the receiver or other components of the modular chassis or accessories mounted thereon. Additionally, standard torque may be applied to the barrel for connection to the receiver and firearm precision is maintained.

The tool assembly includes a barrel interface, a securement arm and a torque wrench. The tool assembly also comprises a tool fore implement for cooperating with the barrel aft end and a locking member for cooperating with the action. The interchangeable barrel defines an aft end surface which includes at least one mating member, for example, a recess, for mating with the tool fore implement. The locking member is rotatably mounted to the transfer shaft of the tool assembly and is secured to the action. Accordingly, once positioned within the receiver, forces may be applied to the tool assembly to rotate the barrel to release or engage the threaded engagement of the barrel aft end and the receiver fore end. The method of changing the barrel therefore is employed without imparting forces on the action.

DETAILED DESCRIPTION OF THE INVENTION

The present invention will now be described in detail hereinafter by reference to the accompanying drawings. The invention is not intended to be limited to the embodiments described; rather, this detailed description is provided to enable any person skilled in the art to make and practice the invention. The novel interchangeable barrel assembly 1 according to the present invention includes an interchangeable barrel 10 and tool assembly 14 for providing an interchangeable barrel 10 which may be changed without removing the action from the stock chassis 17. In particular, the present invention may be used with a modular firearm which, as shown, is a bolt-action rifle, and more specifically, a bolt-action sniper rifle. It is to be understood, however, to those of ordinary skill in the art that the various aspects of the invention as described herein are suitable for other types of firearms, including various types of semi-automatic and fully automatic firearms such as handguns, rifles, shotgun and other long-barreled firearms having access to the aft end of the receiver. The drawings and description which follows pertains to a bolt action rifle by way of example. As used herein, the term "fore" refers to the end of the relevant component facing the discharge end of the firearm and the term "aft" refers to the end of the component nearest the user of the firearm.

Figure 1:
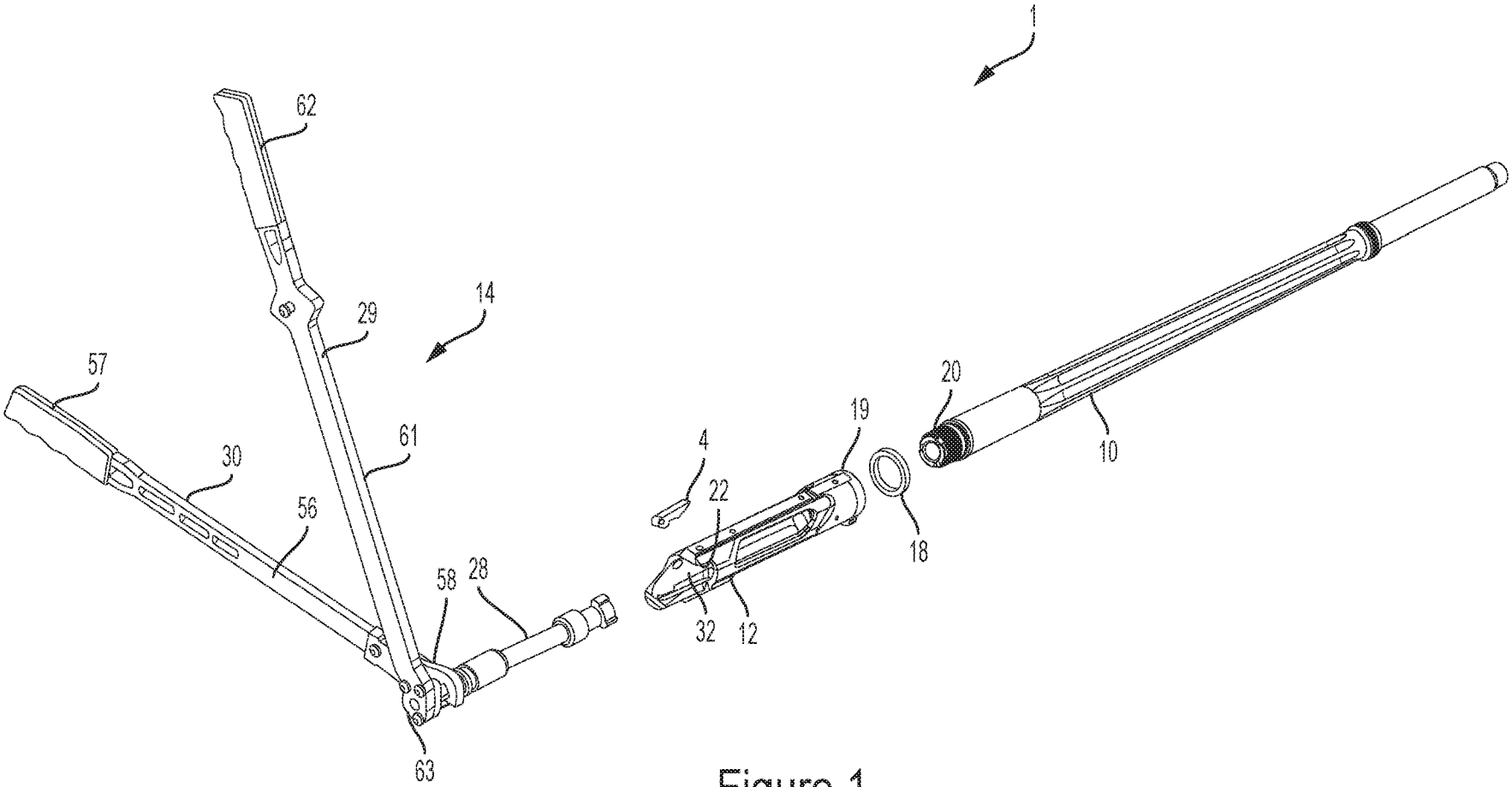
FIG. 1 is an exploded view of the interchangeable barrel assembly, including the tool assembly and interchangeable barrel, and receiver according to the present invention.
Figure 10:
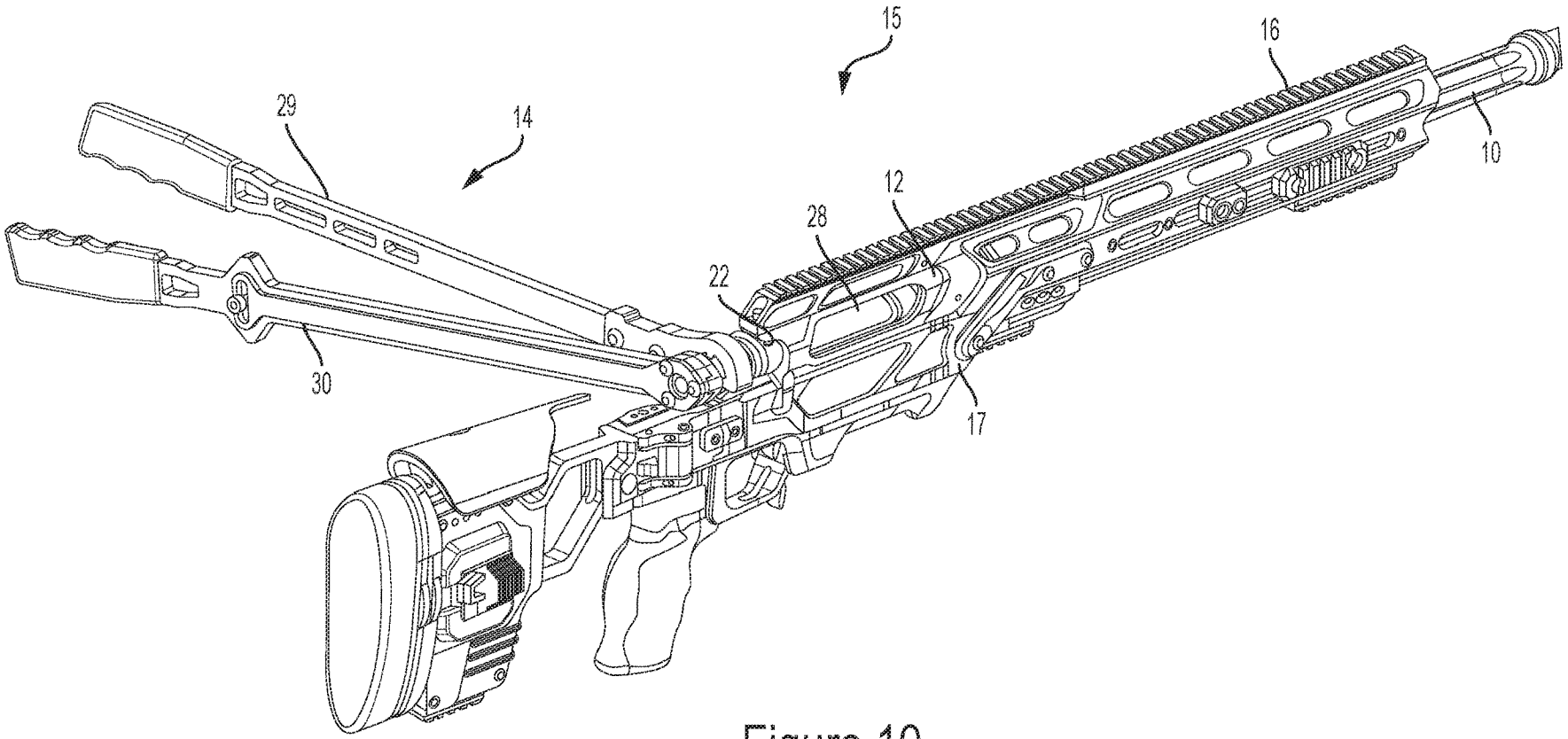
Figure 11:
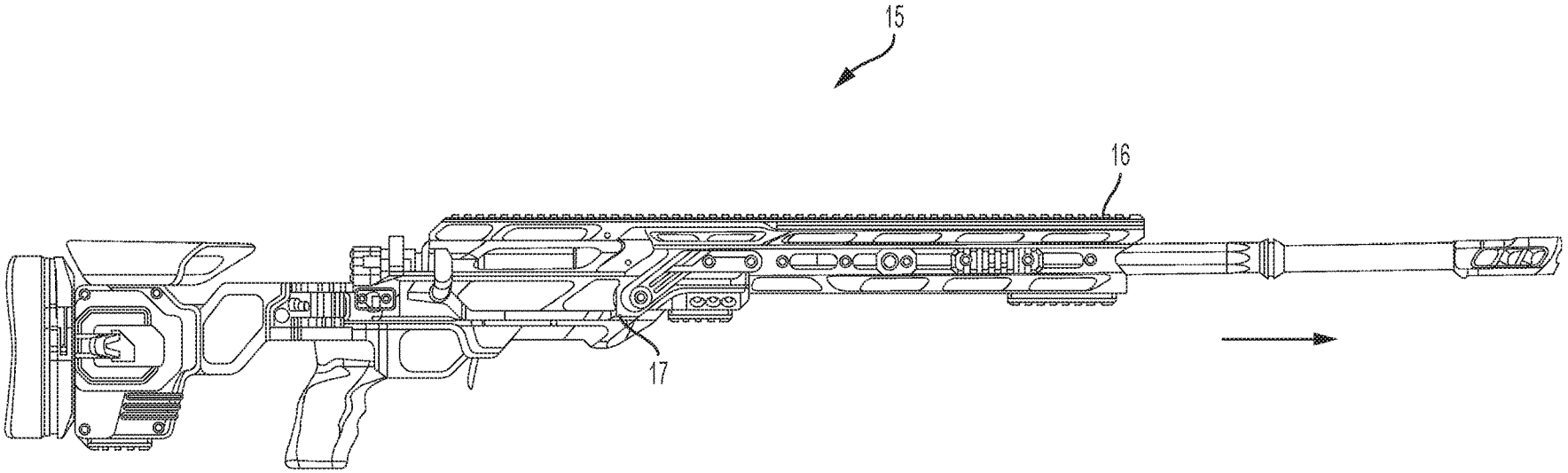
FIG. 11 depicts a modular stock chassis system.
Figure 12:
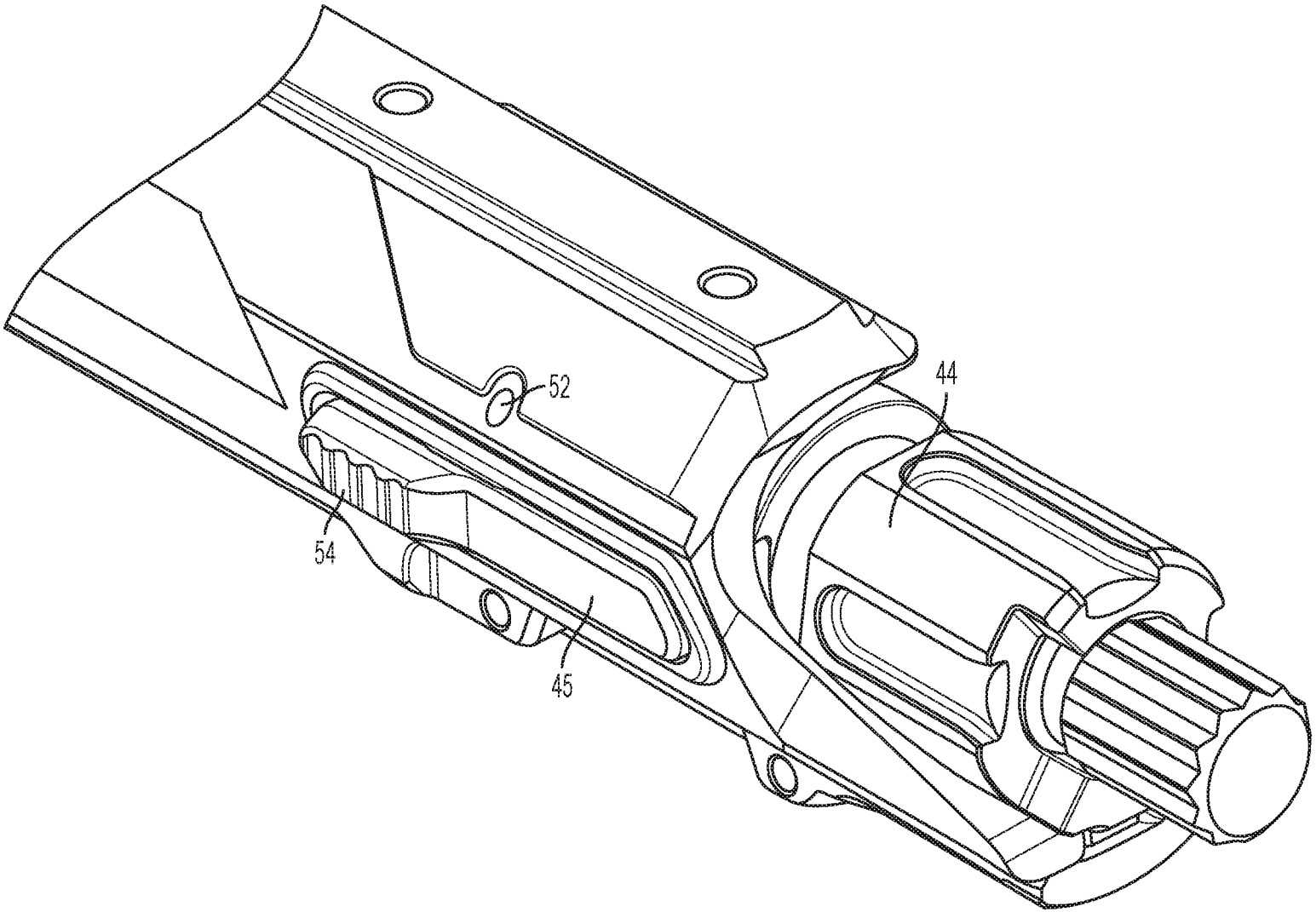
FIGS. 12 and 13 are enlarged views of the barrel interface secured within the receiver.
Figure 13:
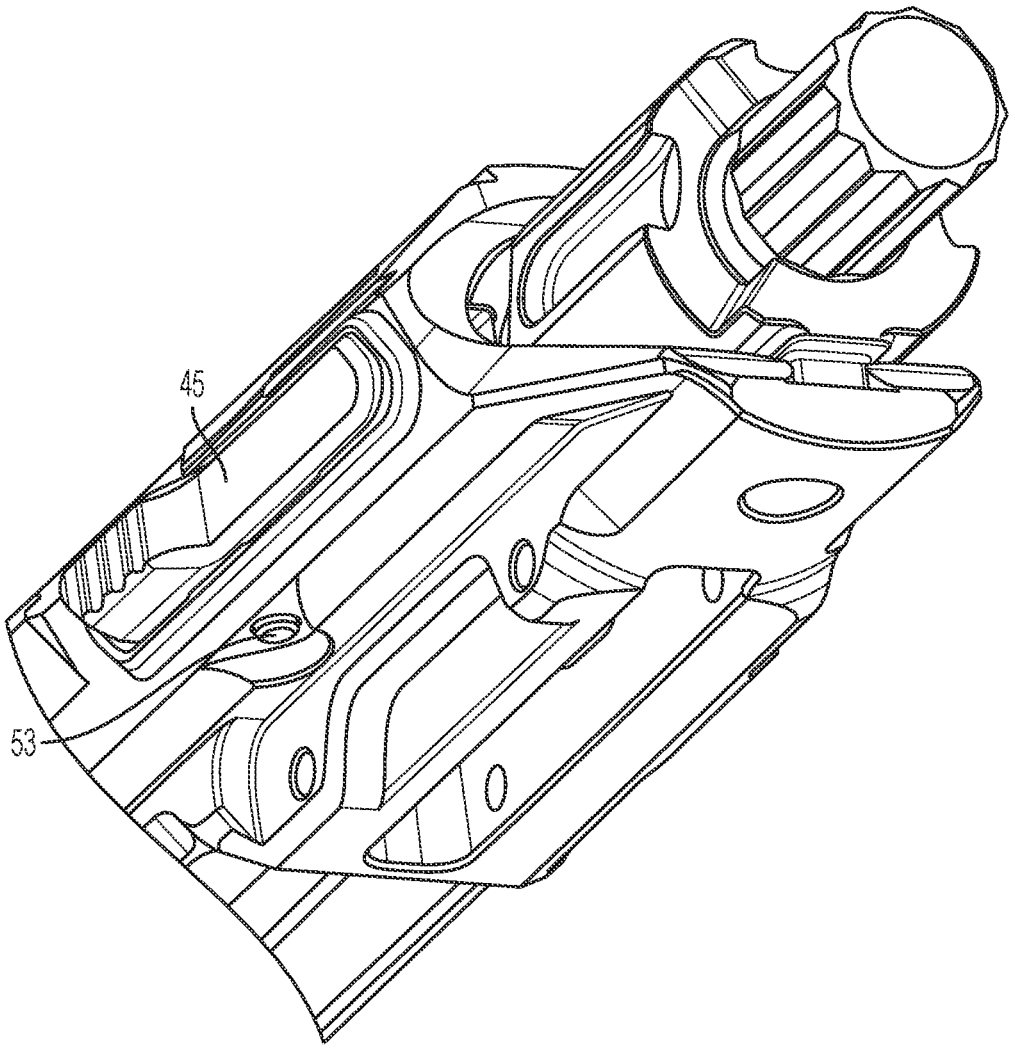

The novel interchangeable barrel assembly 1, as illustrated in FIG. 1, includes an interchangeable barrel 10, a receiver 12 (which houses the hammer, bolt and firing mechanism and which cooperates with the action which manipulates the cartridges and/or seals the breech for firing) and the tool assembly 14. According to one aspect of the present invention, an optional spacer or washer 18 is provided and positioned between the barrel 10 and receiver 12. As shown in FIGS. 10 and 11, the interchangeable barrel assembly 1 according to the present invention is advantageously used with a modular firearm having a modular stock chassis, shown generally at 17, for a bolt action rifle 15. As shown, the barrel 10 aft end 20 is connected to the receiver 12 fore end 19. The aft end 22 of the receiver defines an aperture or opening and the tool assembly 14 is configured for receipt therein. The rifle 15 as shown includes a Picatinny rail 16 as is known in the art. The rail 16 is mounted along the upper surface of the stock chassis 17 to support accessories (not shown) thereon.

The receiver 12 and barrel 10, generally, will be constructed of a high strength, durable, but lightweight material, typically a metal or metal alloy such as titanium alloy. The receiver fore end 19 and the barrel aft end 20 may be constructed of the same material as the other portions of the receiver and barrel or the engagement portions may be constructed of a different, durable, high strength material. For example, the engagement portions can be constructed of steel, thereby providing a steel-on-steel lock up arrangement.

Figure 2A:
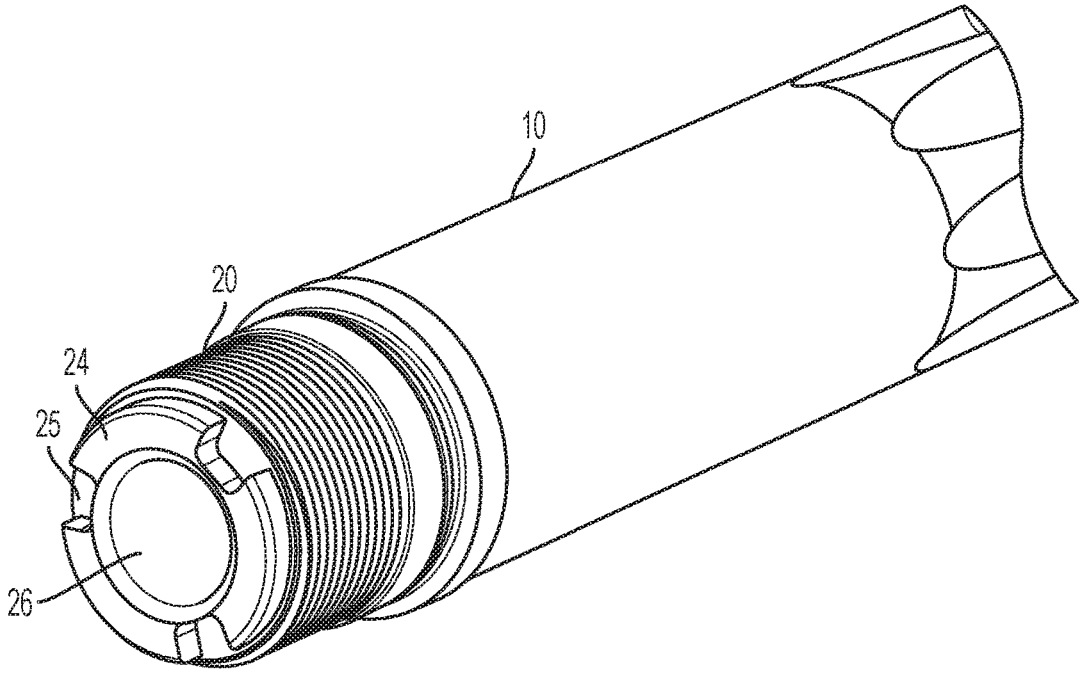
FIGS. 2A and 2B are enlarged illustrations of the barrel aft end according to the present invention and the prior art.
Figure 2B:
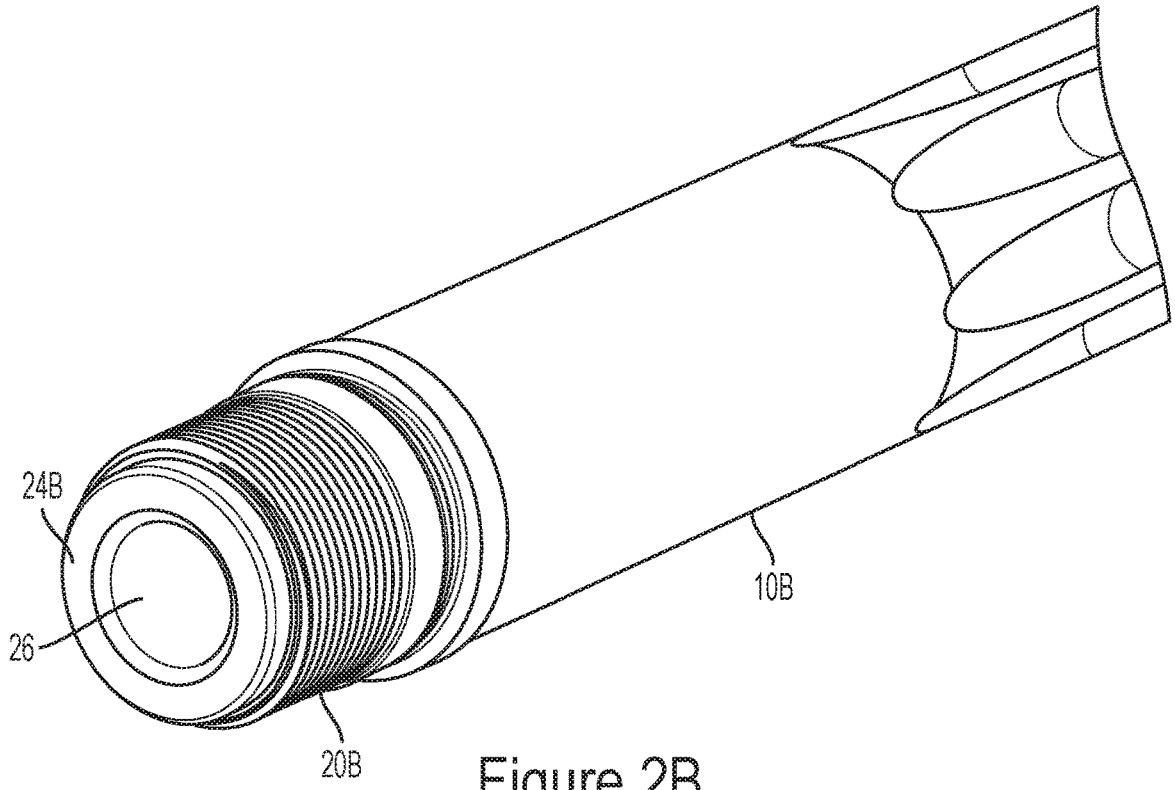

FIGS. 2A and 2B depict a conventional barrel 10B and an interchangeable barrel 10 according to the presently disclosed invention. Conventional barrels 10B include a barrel aft end 20B which includes a threaded external surface along its circumference. The barrel aft end 20B is configured to mate with the threaded internal surface of the receiver fore end 19. The exterior thread pattern of the barrel and the interior thread pattern of the receiver are complimentary so the barrel may be readily and securely attached to the receiver upon the application of appropriate torque. As shown in FIG. 2, a conventional barrel aft end 20B has an end surface 24B defining the end of the longitudinally extending passage 26 of the barrel 10, 10B. Conventional barrel 10B has an end surface 24B having a regular, smooth exterior circumferential which is received within the receiver 12.

According to the present invention, the interchangeable barrel 10 includes a differently configured end surface 24 which is received within the receiver 12 when the barrel 10 is engaged with the receiver 12. Importantly, the threaded portion or barrel aft end 20 comprises standard thread patterns wherein the interchangeable barrel 10 of the present invention may be used with stock systems with the same torque and firearm precision. As best shown in FIG. 2, the barrel end surface 24 extending beyond the barrel threaded aft end 20 defines the opening to the longitudinally extending passage 26 of the barrel 10 and includes at least one recess 25. According to one aspect of the present invention, three, equally spaced recesses 25 are provided about the barrel end surface 24 circumference. It is within the scope of the present invention, however, to provide one or any number of the recesses 25 described herein. The recesses 25 provide a conduit for receipt of the tool assembly 14.

Figure 3:
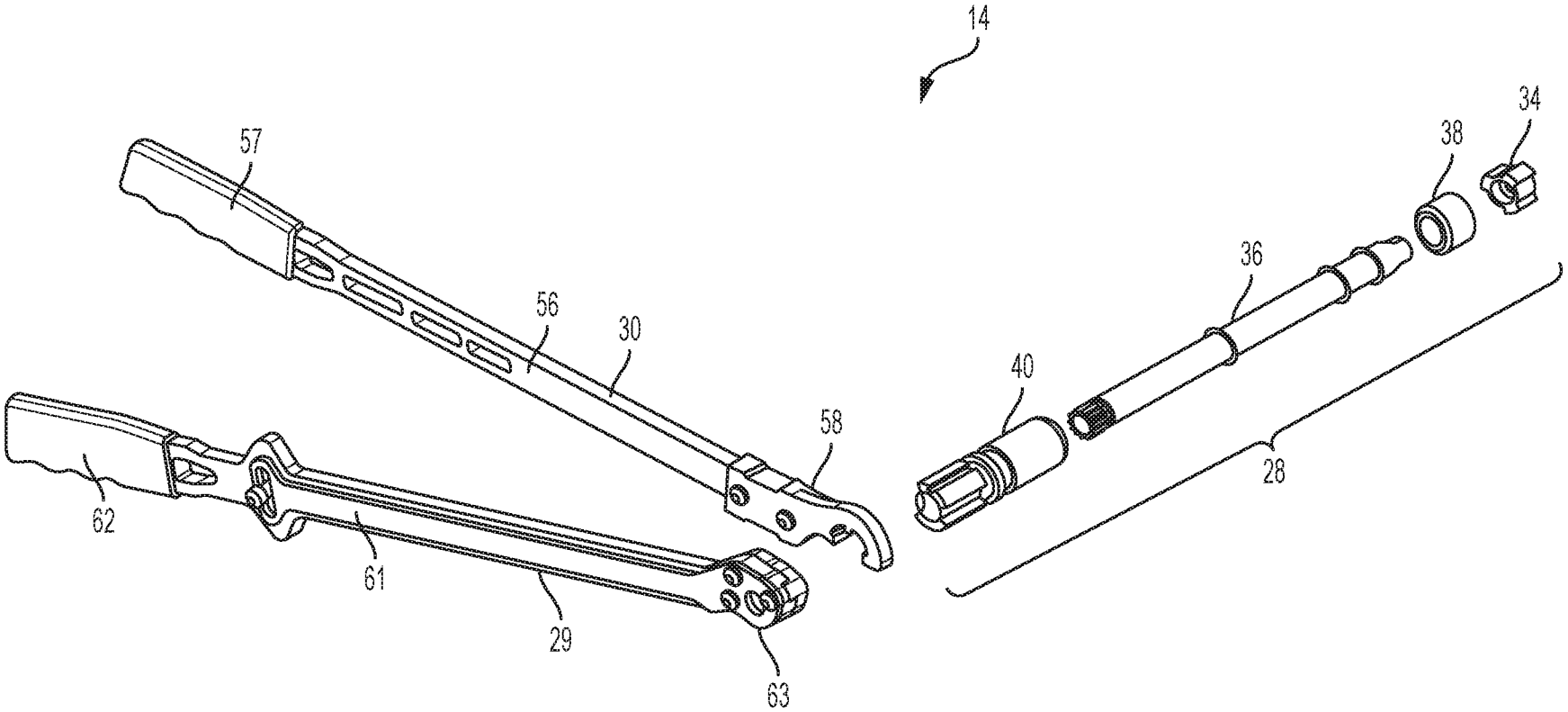
FIG. 3 is an exploded view of the tool assembly.
Figure 4:
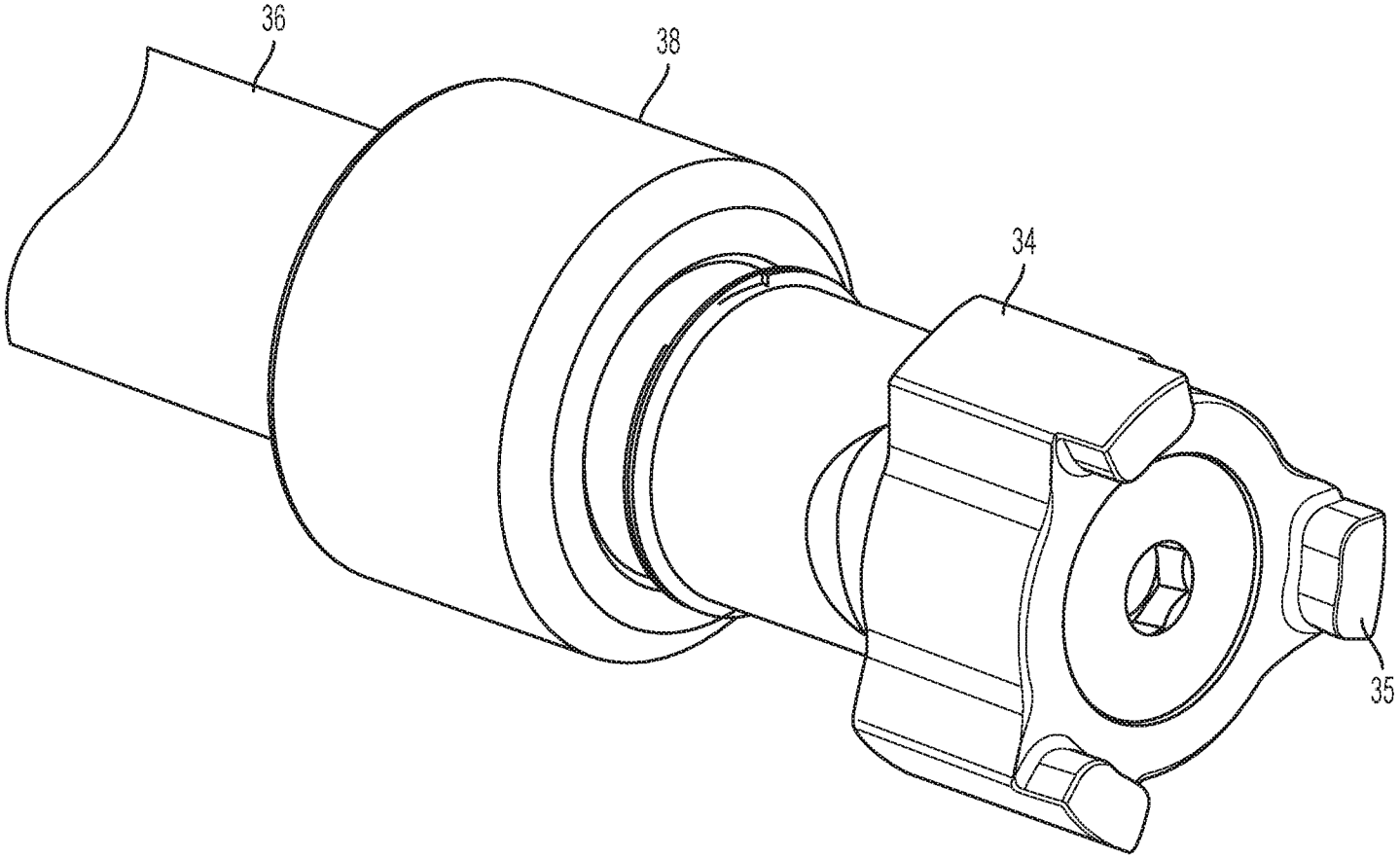
FIG. 4 is an enlarged view of fore end of the tool assembly.
Figure 5:
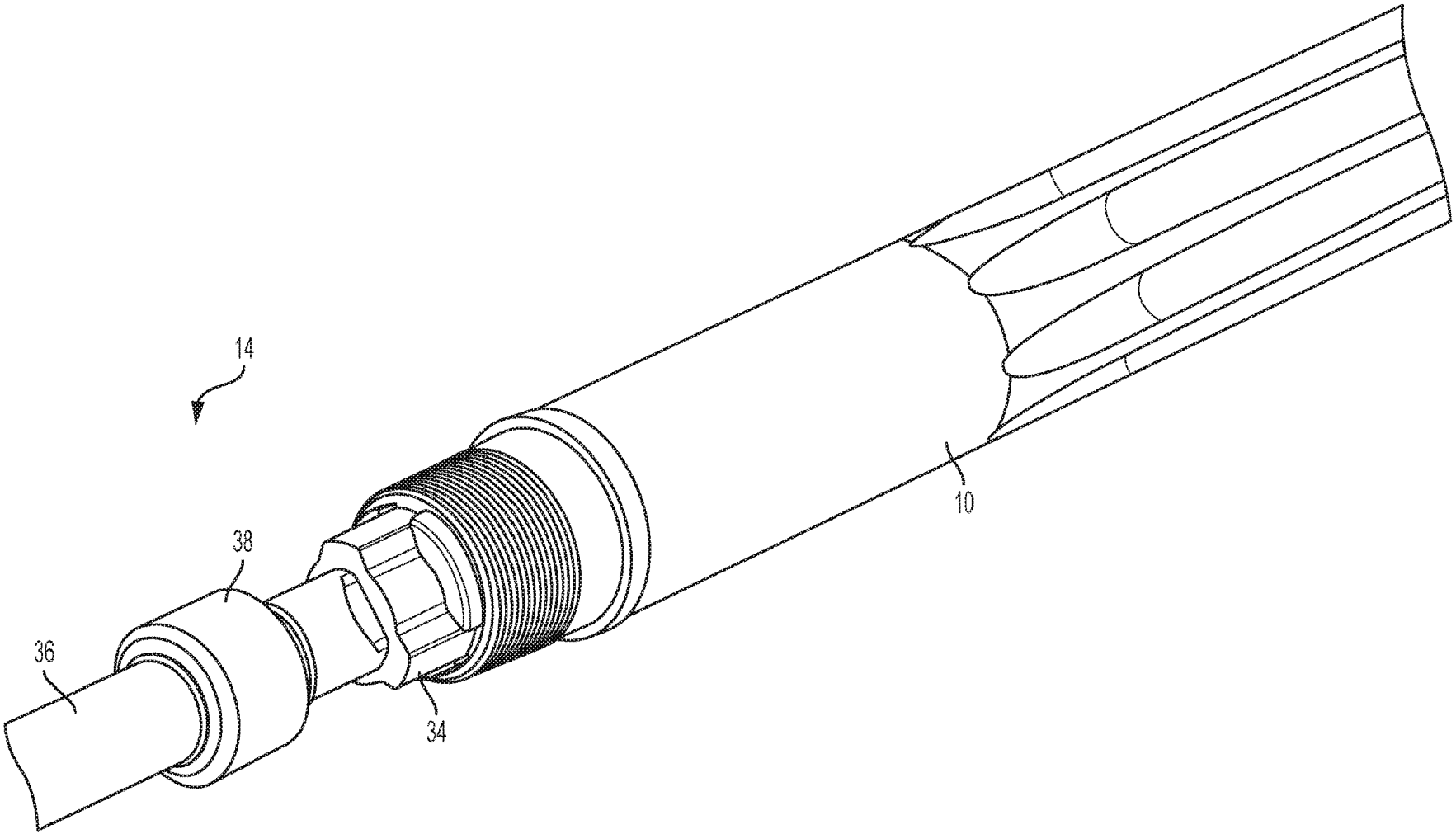
FIG. 5 is an enlarged view of the tool assembly and the barrel in an engaged position.

The tool assembly 14 includes three portions: the barrel interface 28, the torque wrench 29 and the securement arm 30. As shown in FIGS. 1 and 10, the barrel interface 28 is configured to be inserted within the receiver aft end 22 and extends coaxially along the length of the receiver interior passage 32. As shown in FIGS. 1, 3 and 4, the barrel interface 28 includes a fore implement 34. The implement 34 is configured to mate and cooperate with the barrel end surface 24 and its one or more recesses 25. The implement 34, best shown in FIG. 4, includes at least one projection or lug 35 configured to mate with the barrel recess 25. FIG. 5 illustrates the engaged position of the tool assembly 14 and the barrel 10. According to one aspect of the present invention, three projections 35 are provided corresponding to the number of barrel recesses 25 as shown. As shown, the projections 35 are positioned on the tool assembly 14 and the recesses 25 on the barrel end surface 24, however, it is within the scope of the present invention to reverse these wherein the recesses are on the tool assembly 14 and the projections on the barrel end surface 24. It is within the scope of the present invention, also to provide any cooperating connection between the tool assembly 14 and the barrel 10.

Figure 6:
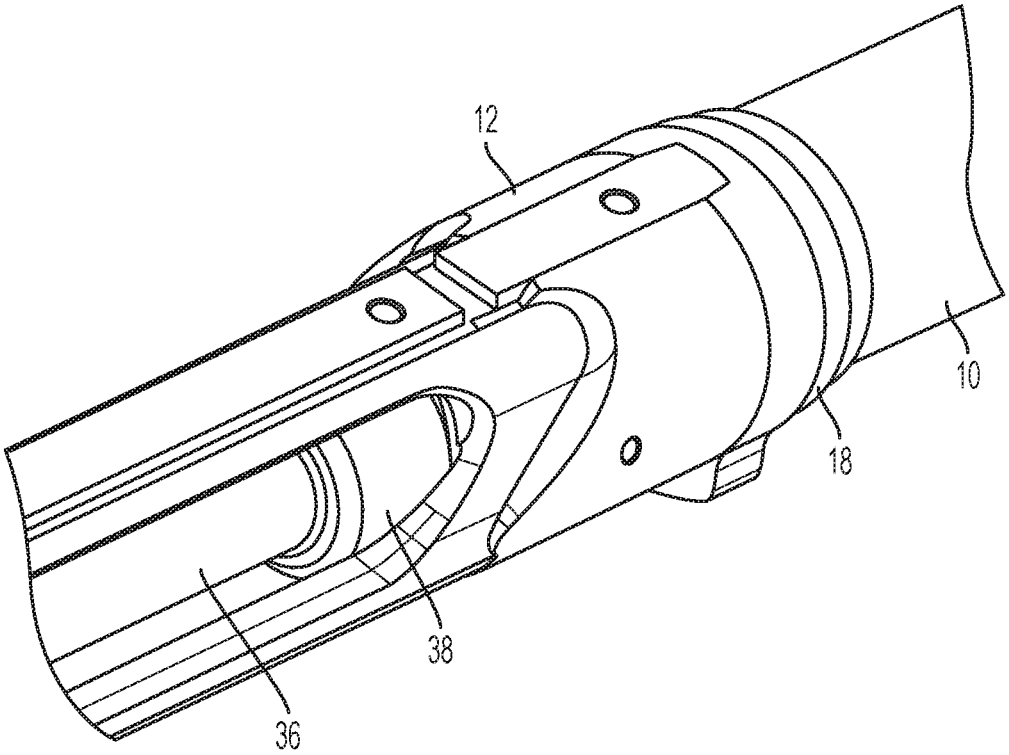
FIG. 6 is a partially broken away view of the tool locking member in an engaged position.

The barrel interface 28 also includes a transfer shaft 36 which supports the fore implement 34 on its end and supports a bushing 38 shown in FIGS. 3 and 4. The bushing 38 assists with the alignment of the barrel interface 28 with the barrel 10 in operation and facilitates rotation of the transfer shaft 36 without damaging the action as shown in FIG. 6. It is within the scope of the present invention for the tool fore implement 34 to be removable from the transfer shaft 36 or formed integrally with the shaft 36.

Figure 7:
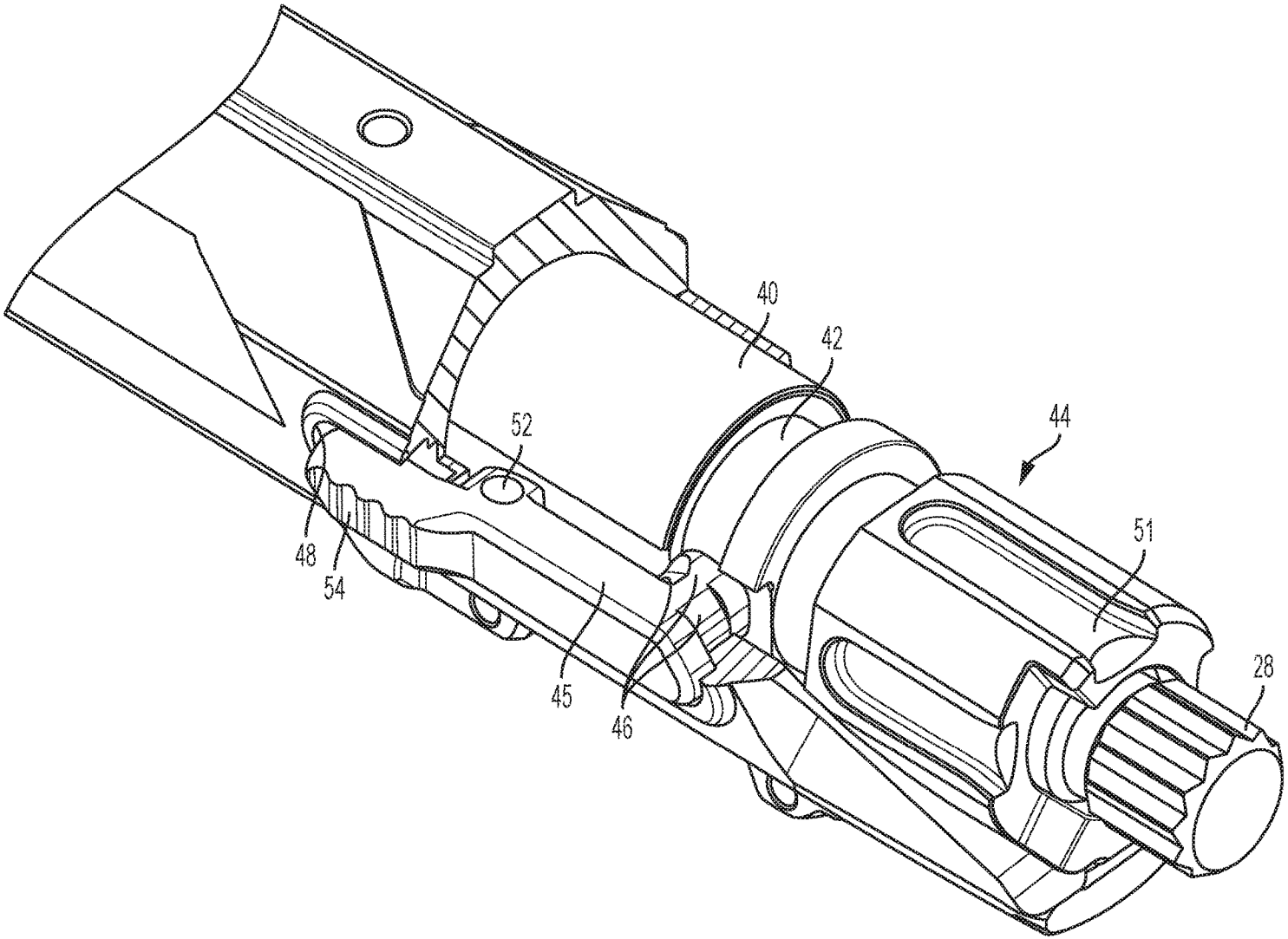
FIGS. 7 and 8 are partially broken away and partially in cross section and depict the tool assembly and the receiver in an engaged position.
Figure 8:
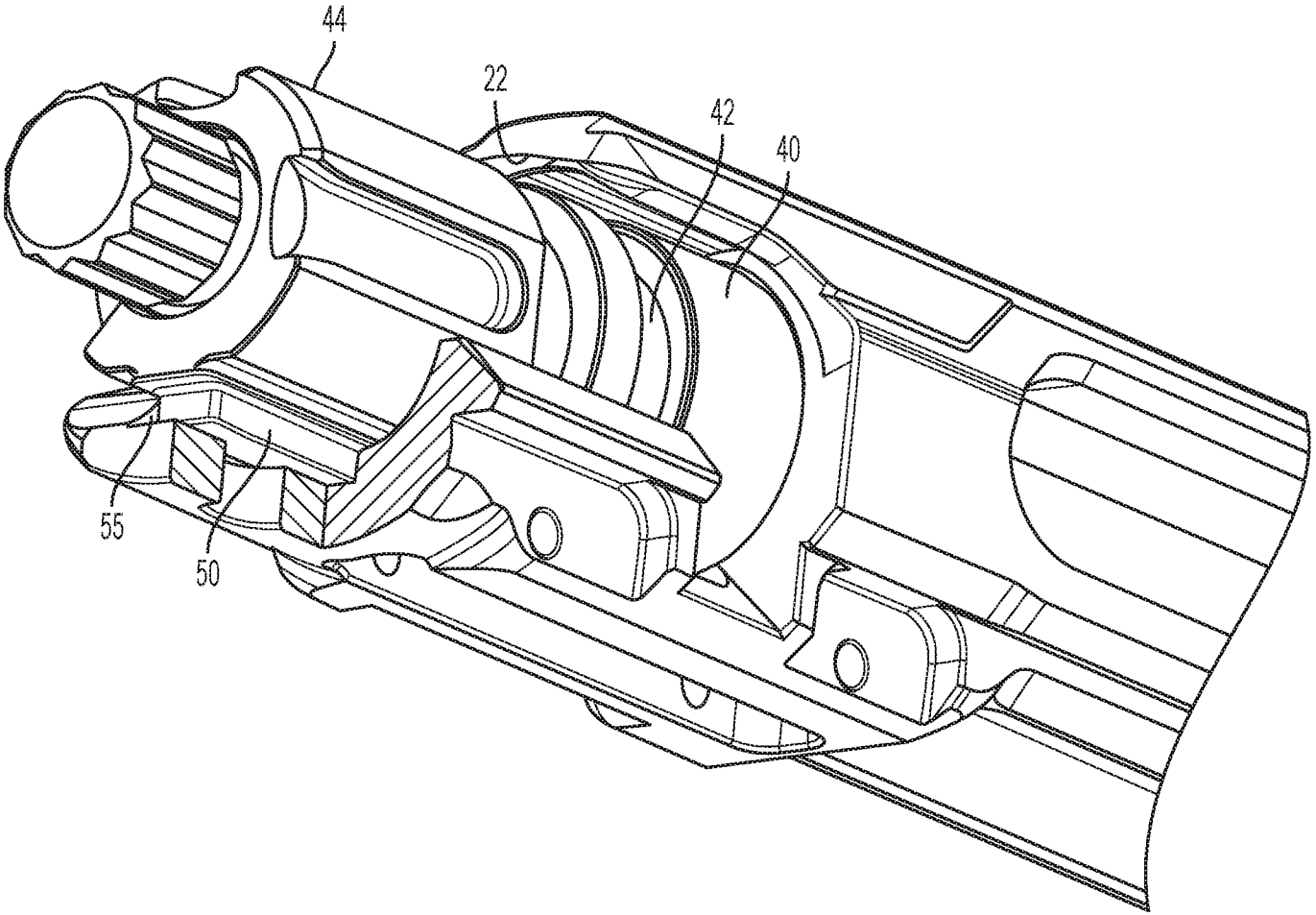

The barrel interface 28 also includes a first locking member 40 defining a circumferentially extending channel 42 as shown in FIGS. 7 and 8. The first locking member 40 is rotatably mounted to the transfer shaft to facilitate alignment of the tool fore implement 34 with the barrel end surface 24 and alignment of the locking member 40 with the receiver 12 for removable/application of interchangeable barrel 10. A bolt stop 45 is provided to both lock the locking member 40 into an engaged position once the barrel interface has engaged the barrel 10 at its aft end 20 and to substantially prevent movement of the bolt when the bolt is opened for cartridge ejection. Once the locking member 40 is secured to the receiver 12 by the bolt stop 45, relative rotational movement between the locking member 40 and the receiver is prevented. Additionally, rearward movement or movement in the aft direction, is substantially prevented which is advantageous when changing the barrel 10 of the interchangeable barrel assembly 11.

More specifically, as shown in FIGS. 7, 8, 12 and 13, the bolt stop 45 includes an inwardly facing finger or protrusion 46 which is configured to engage and cooperate with the channel 42. Accordingly, when the transfer shaft 36 is inserted into the receiver passage 32, and extends co-axially therewith, the bolt stop 45 is inserted through the pocket 48 for receiving the bolt stop. When inserted into the breech 48, the bolt stop 45 cooperates with the breech 48 and the finger 46 engages the channel 42 to prevent unintentional movement (longitudinal and rotational movement) of the transfer shaft 36 during assembly or disassembly of the interchangeable barrel 10. The bolt stop 45 is inserted into the action opening/breech and a pin 53 is inserted into an aperture 52 to retain the bolt stop 45 within the action. The bolt stop 45 also includes a contact surface 54 for facilitating insertion and removal of the bolt. Contact surface 54 is spring biased outward, perpendicular to the axis of the tool assembly 14 so as to urge the finger 46 into engagement with the channel 42. As such, the bolt stop 45 may pivot about the pin 53 within aperture 52 to facilitate engagement and disengagement of the finger 46 to and from the channel 42 for interchanging the barrel 10.

The aft end of the barrel interface 28 of the tool assembly 14 also includes tool assembly interface 44 which includes at least one protrusion 50 and at least one recess 51 as shown in FIGS. 7 and 8. According to one aspect of the present invention, as shown, the aft end of the barrel interface 28 defines one protrusion 50 and three recesses 51. As shown in FIGS. 7 and 8, according to one aspect of the present invention, one protrusion 50 is configured to cooperate with a correspondingly configured slot 55 of the action for preventing rotation of the tool assembly 14 relative to the action.

At least one recess 51 of the tool assembly interface 44 is configured to cooperate with the securement arm 30. When engaged by the tool assembly 14, the locking member 40 is substantially prevented from rotational movement with the action. When the securement arm 30 is engaged with the locking member 40, it secures the firearm chassis while enabling rotational movement of the transfer shaft 36 and, hence, the barrel 10, when changing the barrel 10. According to another aspect of the invention, the securement arm 40 may be integrally formed with the locking member 40 rather than removably connected thereto.

The barrel 10 may be disassembled from or assembled to the interchangeable barrel assembly 11 without removing the action of the firearm. This is accomplished by utilizing the tool assembly 14 by insertion of the barrel interface 28 within the aft opening of the receiver 12, best shown in FIG. 10. The barrel interface 28 may be rotated such that the tool fore implement 34 and projections 35 mate with the corresponding recesses 25 of the barrel end surface 24. The locking member 40 is thus rotated upon the transfer shaft 36, if necessary, to align the cooperating tool assembly interface protrusion 50 with the action slot 55. The securement arm 30 is then applied around the aft end of the barrel interface 28 and slid in the fore direction to engage the locking member 40 of the tool barrel interface 28.

Figure 9:
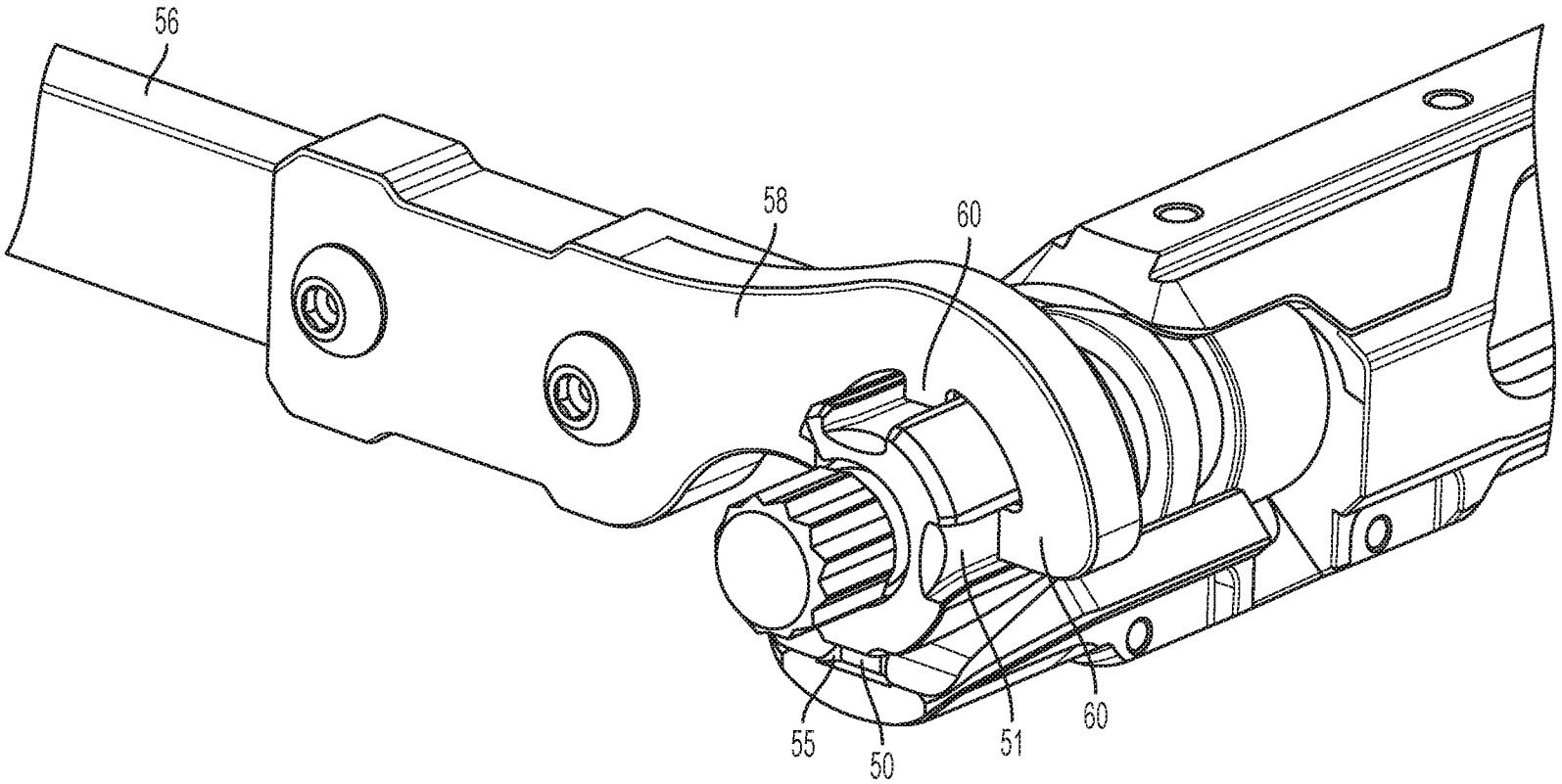
FIGS. 9 and 10 depict the method of operating the tool assembly.

The securement arm 30, as shown in FIGS. 1, 3 and 9 includes an arm 56 having a handle 57 on one end and a grip member 58 on its other end. The grip member 58 includes a jaw-like configuration including a pair of inwardly projecting fingers 60, shown in FIG. 9, for cooperating with and engaging with adjacent recesses 51 of the locking member 40 so as to engage a protrusion 50 defined by adjacent recesses 51. This thereby secures the tool assembly interface 44 relative to the receiver 12 while permitting the barrel interface 28 to rotate when torque is applied to the torque wrench 29. This occurs without applying torque forces to the locking member 40 (which is secured to the receiver by the bolt stop 45, at least) and, therefore, the action.

The torque arm 29 includes an arm 61, a handle 62, and a wrench end 63. When the securement arm 30 is secured with the tool assembly interface 44, the torque arm 29 is applied to the end of the barrel interface 28 and slid along its length until fully receiving the transfer shaft 36 as shown in FIG. 10. Accordingly, one hand of the user may be used to hold the securement arm 30 while applying alternating downward and upward action/pressure to the torque wrench so as to apply torque forces to the transfer shaft 36 and the tool fore implement 34 to rotate the barrel 10 without imparting forces to the action. The user may then remove the barrel 10 and, if necessary, apply finishing twist action to the barrel 10 to finally remove the threaded barrel aft end 20 from the threaded receiver fore end 19.

To assemble an interchangeable barrel 10 to the stock chassis 17, the barrel 10 is initially inserted into the receiver 12 and, preferably, minimal torque is applied to the barrel 10 to initially engage the threaded barrel aft end 20 with the threaded receiver fore end 19. The securement arm 30 is then applied and the torque wrench 29 as previously described. Torque forces in the opposite direction may be applied to secure the threaded connection between the barrel 10 and receiver 12 without imparting forces to the action of the firearm. The novel interchangeable barrel assembly 11 according to the present invention provides for the interchangeable barrel 10 to be torqued similar to a standard barrel without removing it from the stock. Accordingly, the interchangeable barrel assembly 1 of the present invention maintains the desired, predetermined headspace.

Figure 14:
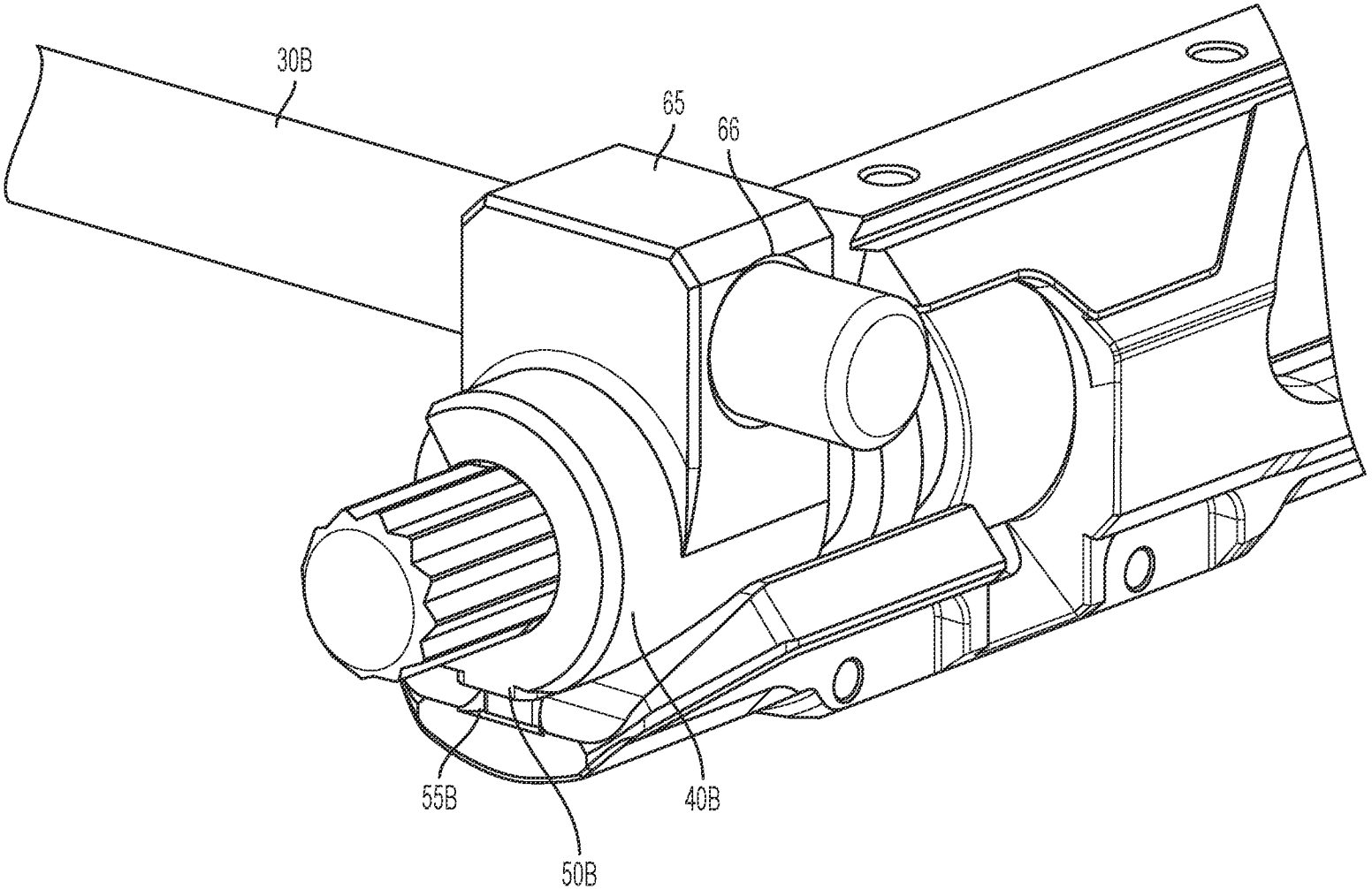
FIG. 14 depicts a locking member according to another aspect of the present invention.

FIG. 14 depicts an interchangeable barrel assembly 1 as described above with locking member 40B and securement arm 30B according another aspect of the present invention. The locking member 40B matingly engages with the firearm action with a protrusion 50B which is received within the slot 55B of the action as described above. The locking member 40B includes an outwardly extending extension 65 defining an aperture 66. The securement arm 30B has a fore end which is configured to mate with the aperture 66. As such, the arm 30B may be used to secure the locking member 40B from rotational movement relative to the action and is secured by the securement arm 30B.

While exemplary embodiments have been shown and described above for the purpose of disclosure, modifications to the disclosed embodiments may occur to those skilled in the art. The disclosure, therefore, is not limited to the above precise embodiments and that changes may be made without departing from its spirit and scope.

What is claimed is:

1. A method of changing an interchangeable barrel of a firearm having a chassis including a receiver housing an action, the receiver having an open aft end, said method comprising: removing a first interchangeable barrel from the receiver using a tool assembly while the action is installed on the chassis, wherein said tool assembly is inserted through the action from an aft end thereof for engagement with the first interchangeable barrel, wherein said first interchangeable barrel has an aft end adapted to engage said tool assembly, said aft end of said first interchangeable barrel mated to the receiver, said tool assembly adapted to apply torque to the first interchangeable barrel, wherein said tool assembly engages said aft end of said first interchangeable barrel through the open aft end of the receiver.

2. The method of claim 1, wherein said aft end of said first interchangeable barrel comprises a surface having one or more spaced mating members adapted to engage said tool assembly.

3. The method of claim 1, wherein said tool assembly comprises a barrel interface and a torque wrench adapted to apply torque to the barrel interface.

4. The method of claim 3, wherein said barrel interface comprises a fore implement configured to mate with said aft end of said first interchangeable barrel.

5. The method of claim 1, wherein said tool assembly comprises a locking member and a securement arm having a grip adapted to engage the locking member.

6. The method of claim 1, wherein said firearm is a modular firearm comprising a modular stock chassis.

7. The method of claim 1, further comprising assembling a second interchangeable barrel onto said firearm using said tool assembly while the action is still installed on the chassis of the firearm.

8. The method of claim 1, wherein said interchangeable barrel is removed from said firearm by applying torque directly to the interchangeable barrel.

9. An interchangeable barrel assembly for a firearm having a receiver, the interchangeable barrel assembly comprising an interchangeable barrel and a tool assembly, wherein said interchangeable barrel comprises an aft end having a surface comprising one or more spaced mating members adapted to engage said tool assembly for removal of said interchangeable barrel, the aft end of the interchangeable barrel adapted to mate to a fore end of the receiver, said tool assembly adapted to apply torque to the interchangeable barrel, wherein said tool assembly engages said aft end of said first interchangeable barrel through an open aft end of the receiver.

10. The interchangeable barrel assembly of claim 9, wherein said tool assembly comprises a barrel interface having a fore end configured to mate with said one or more spaced mating members of said aft end of said interchangeable barrel.

11. The interchangeable barrel assembly of claim 9, wherein said tool assembly further comprises a locking member adapted to be secured to an action housed in the receiver of the firearm.

12. The interchangeable barrel assembly of claim 9, wherein said tool assembly further comprises a securement arm having a grip.

13. The interchangeable barrel assembly of claim 10, wherein said barrel interface is configured to be inserted into the receiver and extend coaxially along the length of the receiver towards said aft end of said interchangeable barrel.

14. A firearm and tool assembly comprising: a receiver housing an action, an interchangeable barrel including a barrel aft end having a threaded external surface along its circumference and an end surface defining the end of a longitudinally extending passage of the interchangeable barrel, the threaded external surface of the interchangeable barrel threadably engaged with corresponding threads provided at a fore end of the receiver, said end surface of the interchangeable barrel extending beyond the threaded barrel aft end and including at least one mating member configured to engage with a tool assembly insertable through an open aft end of the receiver for applying a torque to the interchangeable barrel without removing the action from the receiver.

15. The firearm and tool assembly barrel of claim 14, wherein said at least one mating member comprises a recess.

16. The firearm and tool assembly of claim 14, wherein said end surface comprises at least three equally spaced mating members about the circumference of the end surface.

* * * * *